United States Patent [19]

Troesch

[11] 4,226,340

[45] Oct. 7, 1980

[54] TISSUE TREATMENT DISPENSER

[76] Inventor: Louis Troesch, 1590 Anderson Ave., Fort Lee, N.J. 07024

[21] Appl. No.: 933,802

[22] Filed: Aug. 15, 1978

[51] Int. Cl.[3] ..... B65D 83/14

[52] U.S. Cl. ..... 222/183; 222/205

[58] Field of Search ..... 222/108, 402.1, 180, 222/183, 402.18, 205, 182, 207, 211

[56] References Cited

U.S. PATENT DOCUMENTS

| | | | |
|---|---|---|---|
| 2,593,591 | 4/1952 | Menkin et al. | 222/205 |
| 3,185,352 | 5/1965 | Ghisolfi | 222/211 X |
| 4,087,022 | 5/1978 | Streccia | 222/183 |
| 4,087,023 | 5/1978 | Szczepanski | 222/211 X |

*Primary Examiner*—Stanley H. Tollberg
*Attorney, Agent, or Firm*—McGlew and Tuttle

[57] ABSTRACT

A tissue treatment dispenser for dispensing a treatment fluid from an aerosol emitting container comprising, a bottom housing for holding the container, a top housing telescopically engaged with the bottom housing and over the container, and an aerosol emitting valve connected to the top housing and engaged with the container for emitting aerosol from the container when the valve is actuated by displacing the top housing downwardly with respect to the bottom housing. The top housing includes a conical chamber communicating with an opening in the aerosol emitting valve for dispersing aerosol from the container with the aerosol emitting valve defining a plurality of channels communicating the conical space with the interior of the top housing for aiding in the dispersion of the aerosol emitted. Tissue to be treated is suspended across the conical space and pressed downwardly against the top housing to activate the aerosol emitting valve and dispense the treating fluid against a surface of the tissue facing the conical space.

5 Claims, 2 Drawing Figures

TISSUE TREATMENT DISPENSER

FIELD AND BACKGROUND OF THE INVENTION

The present invention relates in general to tissue treatment dispensers for treating tissues such as toilet and cleansing tissues and, in particular, a new and useful tissue treatment device for dispensing a treatment fluid from an aerosol emitting container onto a surface of a tissue which is pressed to the top of the dispenser.

DESCRIPTION OF THE PRIOR ART

Devices are known for treating the surface of, for example, toilet tissue with an aerosol type container as exemplified in U.S. Pat. No. 3,776,773 to Taft. In FIG. 1 of this patent it is shown that toilet tissue can be removed from a roll and positioned on a target area which can be sprayed with a moistening agent from an aerosol container. Devices are also known which provide for the moistening of rolled tissue using moistening rollers in a housing as exemplified by U.S. Pat. No. 1,869,806 to Gale.

Although various advantages can be realized by moistening tissue, particularly toilet tissue, with deodorizing, cleansing, scented or disinfecting solution, the application of such fluids has hitherto been awkward and difficult, especially in view of the inherent weakness of the tissue material. A simple, economical and convenient method and apparatus for applying such treatment fluids to tissue has not hitherto been suggested, and the provision of such a device and method, in facilitating this treatment of the tissue, would be advantageous in view of the benefits of such treatment.

The present invention suggests the use of a hand-actuated aerosol dispenser having a dispersion cone onto which a toilet or cleansing tissue can be pressed to release the treatment fluid onto the surface of the tissue facing the dispersion cone. U.S. Pat. No. 3,744,678 to Beres et al suggests the use of a hand-actuated member connected to an aerosol can which has a space that is fillable with a foam product such as shaving cream. This patent, although being relevant to the hand-actuatable feature of the present invention, does not anticipate the invention, in that no advantageous dispersion onto a tissue is shown. Also relevant to the invention is a class of aerosol dispersion devices exemplified by U.S. Pat. No. 3,935,974 to Weyn which shows a device for dispersing an aerosol product in a confined area.

SUMMARY OF THE INVENTION

The present invention comprises a tissue treatment dispenser, particularly for dispensing a cleaning, deodorizing, scented or disinfecting fluid onto toilet or cleansing tissue which includes a housing having a bottom portion and a top portion telescopically engaged with the bottom portion, which housing contains an aerosol emitting container which is of the pressurized or pump type. The top housing portion includes a peripheral part which may be cylindrical and engageable around the aerosol emitting container with one end telescopically engaged with the bottom housing portion and an opposite end having a fructo-conical part extending inwardly and downwardly therefrom. A treatment fluid dispersion nozzle is connected to the base of the fructo-conical part and engaged over a neck or a valve part of the aerosol emitting container. In operation, a single or multiple ply of toilet or cleansing tissue may be positioned over the top housing thereby covering a space defined by the fructo-conical part, and a user may press the tissue down against the housing thereby displacing the top housing portion with respect to the bottom housing portion. This displacement presses the nozzle against the valve or neck part of the container, thereby releasing aerosol fluid from the container and into the conical space. The fluid is thereby dispersed and applied to a surface of the tissue facing the space. The tissue can then be used as treated in any standard toiletry function.

Accordingly, an object of the present invention is to provide a tissue treatment dispenser for dispensing a treatment fluid from an aerosol emitting container comprising, a bottom housing, a top housing telescopically engaged with said bottom housing and defining therewith an interior space into which the aerosol emitting container is positionable, said top housing including a conical portion extending downwardly and inwardly from the top thereof for defining a conical dispersion space, a nozzle having a bore therethrough connected to the top housing at the base of said conical portion and engageable over a valve of the aerosol emitting container with said bore communicating with a bore of the valve, and said nozzle and said housing defining a plurality of dispersion channels therebetween whereby a user may position a tissue to be treated over said conical dispersion space and press said top housing downwardly towards said bottom housing to displace the valve of the aerosol emitting container through its engagement with said nozzle to release aerosol from the aerosol emitting container into the conical dispersion space and onto the tissue to be treated.

A further object of the present invention is to provide a method for treating tissue with a housing having a bottom portion and a top portion telescopically engaged with the bottom portion, the top portion having a conical surface extending downwardly and inwardly and terminating at a nozzle which is connected to a valve of an aerosol emitting container within the housing comprising, positioning a tissue to be treated on the top portion and over the downwardly and inwardly extending surface to define a conical dispersion space, pressing the tissue downwardly to displace the top portion with respect to the bottom portion and activate the valve to release fluid from the aerosol emitting container and onto the tissue.

A further object of the present invention is to provide a tissue treatment dispenser which is simple in design, rugged in construction and economical to manufacture.

The various features of novelty which characterize the invention are pointed out with particularity in the claims annexed and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
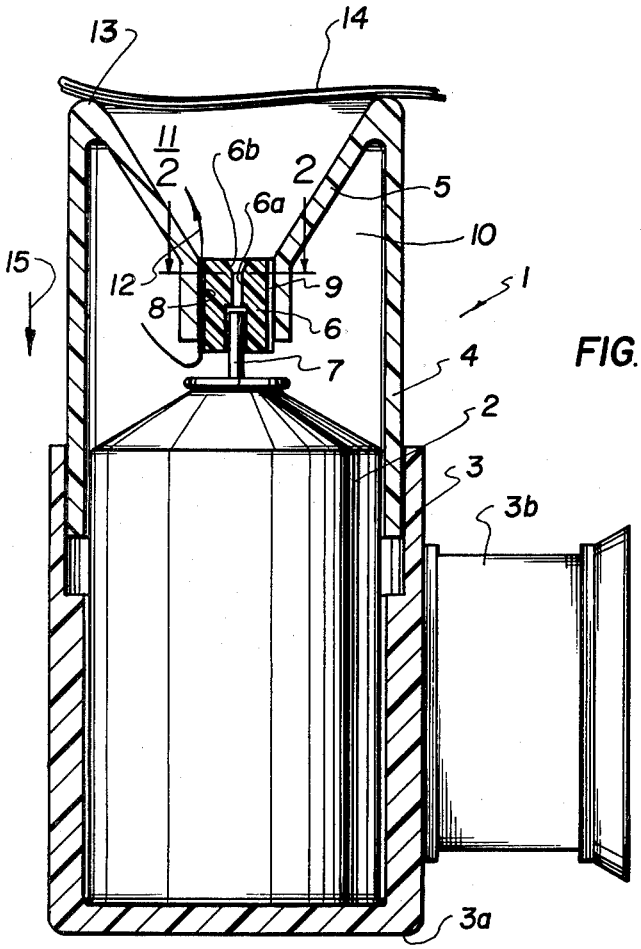
FIG. 1 is a side elevational sectional view of the invention.
Figure 2:
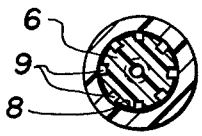
FIG. 2 is a view taken along line 2—2 of FIG. 1.

Referring now to FIG. 1 a dispenser generally designated 1 is disclosed for dispensing a cleansing, deodorizing, disinfecting or similar spray from an aerosol or pump type container 2. Container 2 is housed within a stationary bottom portion or housing 3 and a movable top housing or actuator portion 4 positioned over and telescopically engaged in the bottom portion 3. Actuator 4 includes a funnel shaped spray dispersing cone or conical portion 5 which has a nozzle 6 disposed at the bottom thereof. Container 2 includes a spray valve or neck 7 which can be displaced downwardly to release pressurized treatment fluid from the container 2 or pump the fluid therefrom. Nozzle 6 is disposed in an aperture 8 of actuator 4 which aperture communicates with the conical space 11 of funnel portion 5. Nozzle 6 is press fitted into aperture 8 and includes peripheral dispersion channels 9 which permits a circulation of air from the interior cavity 10 of the actuator 4 out into the cone-shaped space 11 defined by the funnel portion 5. This is best shown in FIG. 2. The flow of air is indicated by an arrow 12 and is utilized to enhance the dispersion of fluid coming from container 2 and out of neck portion 7. Nozzle 6 further includes a channel 6*a* that communicates with the opening of the neck portion 7 and channel 6*a* terminates in a cone-shaped opening 6*b* which further enhances the dispersion of fluid and air in the cone-shaped space 11.

In operation the unit is used in combination with toilet or cleansing tissue whereby a user places the tissue 14 down onto the actuator 4 and in contact with the ring shaped top edge 13 of the funnel portion 5. The user then presses down on the actuator 4 displacing it in the direction indicated by arrow 15 which action displaces the neck portion 7 downwardly, causing pressurized cleansing and disinfectant fluid to leave container 2, pass through channel 6*a* out of cone-shaped opening 6*b* and into the cone-shaped opening 11. Simultaneous with this spraying action, air is channeled through channel 9 in the direction indicated by arrow 12 and, mingling with the spray from container 2 causes the air spray mixture to disperse in the space 11 and be sprayed toward tissue 14. Tissue 14 can then be taken away from the actuator 5 and used for cleansing and toiletry purposes to enhance the cleaning effect and to add a disinfecting effect in the use of tissue 14 above its effect when used dry.

The invention comprises the apparatus as well as the method for using the apparatus and is contemplated for use in rest rooms, where it can be mounted to a horizontal surface on its bottom surface 3*a* or on a wall surface through a bracket 3*b*. The apparatus and method can also be used in a nursery for the cleaning of a baby. It can also be used in airplanes, trains or automobiles for toilet and non-toilet cleaning, disinfecting, deodorizing or similar uses.

While a specific embodiment of the invention has been shown and described in detail to illustrate the application of the principles of the invention, it will be understood that the invention may be embodied otherwise without departing from such principles.

What is claimed is:

1. A tissue treatment dispenser for dispensing a treatment fluid from an aerosol emitting container comprising, a bottom housing, a top housing telescopically engaged with said bottom housing and defining therewith an interior cavity, the aerosol emitting container positionable within said interior cavity and including a valve neck, said top housing having a conical portion extending downwardly and inwardly from the top of said housing and defining a conical dispersion space thereabove and a cylindrical portion depending from the bottom of said conical portion, an aerosol emitting nozzle connected in said cylindrical portion at the base of said conical portion and engageable over the valve neck of the aerosol emitting container, said nozzle having a plurality of dispersion channels spaced on the periphery thereof to form a passage for communicating said interior cavity with said conical dispersion space, said nozzle including a bore therethrough communicating with said valve neck and having a top conical portion for dispersing the aerosol emitted from the aerosol emitting container, said top housing being movable relative to said bottom housing for displacing said valve neck to actuate aerosol fluid emission through said bore so that tissue to be treated which is positioned over and closes said conical dispersion space receives fluid released through said conical dispersion space.

2. A tissue treatment dispenser according to claim 1 wherein said bottom housing has a bottom surface adapted to be connected to a horizontal surface for the mounting of the tissue treatment dispenser.

3. A tissue treatment dispenser according to claim 1 further including a bracket connected to said bottom housing for mounting the tissue treatment dispenser to a vertical surface.

4. A tissue treatment dispenser according to claim 1 wherein the aerosol emitting container is pressurized.

5. A tissue treatment dispenser according to claim 1 wherein the aerosol emitting container is of the pump type.

* * * * *